US006905172B1

(12) United States Patent
Barnett

(10) Patent No.: US 6,905,172 B1
(45) Date of Patent: Jun. 14, 2005

(54) ADJUSTABLE CHAIR DEVICE, KIT AND METHOD OF USING SAME

(76) Inventor: Joe R. Barnett, 230 E. Clover Rd., Tracy, CA (US) 95376

( * ) Notice: Subject to any disclaimer, the term of this patent is extended or adjusted under 35 U.S.C. 154(b) by 0 days.

(21) Appl. No.: 10/713,989

(22) Filed: Nov. 14, 2003

(51) Int. Cl.[7] ..... A47C 1/02
(52) U.S. Cl. ..... 297/344.12; 297/344.15; 297/344.18; 248/188.5
(58) Field of Search ..... 297/344.12, 344.15, 297/344.18; 135/66, 67, 72, 74; 248/188.2, 248/188.5

(56) References Cited

U.S. PATENT DOCUMENTS 4,408,743 A * 10/1983 DeWitt et al. ..... 248/285.1
4,613,185 A 9/1986 Marchesini
4,772,068 A 9/1988 Gleckler et al.
5,271,422 A * 12/1993 Sorrell et al. ..... 135/66
5,364,163 A 11/1994 Hardison
D356,899 S 4/1995 Vasconcellosin
5,435,620 A * 7/1995 Cheng ..... 297/51
5,449,220 A 9/1995 Taylor et al.
5,494,333 A * 2/1996 Wilson ..... 297/344.18
5,499,856 A * 3/1996 Sorrell et al. ..... 297/5
5,848,822 A * 12/1998 Wu ..... 297/344.18
6,036,148 A * 3/2000 Shank ..... 248/188.5
6,056,353 A * 5/2000 Meara ..... 297/41
6,095,607 A * 8/2000 Wenzel ..... 297/344.18
6,471,288 B2 * 10/2002 Alexander, Jr. ..... 297/56
6,520,459 B2 * 2/2003 Burr ..... 248/188.4
6,616,223 B1 * 9/2003 Lin ..... 297/55
6,669,281 B1 * 12/2003 Huang ..... 297/58

* cited by examiner

*Primary Examiner*—Peter M. Cuomo
*Assistant Examiner*—Erika Garrett

(57) ABSTRACT

A chair device, an associated kit and a method of using same are disclosed for use in providing a reclining means for sitting on an uneven surface. The device includes a seat; a back; four upper legs; two armrests; four flanges; four lower legs; and four grommets. The back is pivotally attached to the seat. The four upper legs are pivotally attached to the seat. The each armrest of the two armrests is pivotally attached to two of the four upper legs and pivotally attached to the back. Each flange of the four flanges has an eyelet orifice, wherein each flange is rigidly attached to one of each of the four upper legs. Each lower leg of the four lower legs is slidably engaged within the eyelet orifice of one of each of the four flanges. Each grommet of the four grommets has a lock hole, in which each grommet is pivotally attached to one of each of the four upper legs, wherein the lock hole of each grommet is slidably engaged with one of each of the four lower legs. The kit includes the unassembled constituents of the device. The method includes the steps of adjoining, abutting, affixing, conjoining, connecting, joining, linking, obtaining, opening, positioning, and sitting.

2 Claims, 3 Drawing Sheets

ADJUSTABLE CHAIR DEVICE, KIT AND METHOD OF USING SAME

FIELD OF THE INVENTION

The present invention relates to an adjustable chair device, an associated kit and a method of using same for use in providing a means for reclining on an uneven surfaces.

BACKGROUND OF THE INVENTION

Currently available folding chairs are designed to be used on level, even terrain. Any attempt to use the commonly available folding chair on sloping or uneven terrain places the user at risk of sliding or tipping over. Barring such a catastrophic accident, the user is still subjected to sitting at an odd, uncomfortable angle that matches the slope of the terrain upon which the chair is placed. This deficiency in current folding chairs precludes the use of a chair in many common outdoor settings, such as on hillsides overlooking sporting fields, river banks and lake banks.

A wide variety of chairs is currently available on the commercial market and an even larger number of these types of devices are known in the art of chairs, for example, the folding chair disclosed by Marchesini in U.S. Pat. No. 4,613,185; the adjustable fishing and camping chair disclosed by Gleckler et al. in U.S. Pat. No. 4,772,068; the adjustable leg fishing chair disclosed by Hardison in U.S. Pat. No. 5,364,163; the selectable height folding chair apparatus disclosed by Taylor et al. in U.S. Pat. No. 5,449,220; the hillside chair disclosed by Wilson in U.S. Pat. No. 5,494,333; the universal adjustable chair disclosed by Wenzel in U.S. Pat. No. 6,095,607; and the adjustable lawn chair disclosed by Vasconcellosin U.S. Pat. No. D356,899.

While all of the above-described devices fulfill their respective, particular objectives and requirements, the aforementioned patents do not describe an adjustable chair device having the interconnected elements of seat; a back; four upper legs; two armrests; four flanges; four lower legs; and four grommets. This combination of elements would specifically match the user's particular individual needs of making it possible to provide a reclining means for sitting on an uneven surface. The above-described patents make no provision for an adjustable chair device having the interconnected elements of seat; a back; four upper legs; two armrests; four flanges; four lower legs; and four grommets.

Therefore, a need exists for a new and improved adjustable chair device having an adjustable chair device having the interconnected elements of seat; a back; four upper legs; two armrests; four flanges; four lower legs; and four grommets. In this respect, the adjustable chair device according to the present invention substantially departs from the conventional concepts and designs of the prior art, and in doing so provides an apparatus primarily developed for the purpose of providing a reclining means for sitting on an uneven surface.

SUMMARY OF THE INVENTION

The present device, kit and method of using, according to the principles of the present invention, overcomes the shortcomings of the prior art by providing a novel and nonobvious adjustable chair device, kit and method of using the same. The device includes a seat; a back; four upper legs; two armrests; four flanges; four lower legs; and four grommets. The back is pivotally attached to the seat. The four upper legs are pivotally attached to the seat. The each armrest of the two armrests is pivotally attached to two of the four upper legs and pivotally attached to the back. Each flange of the four flanges has an eyelet orifice, wherein each flange is rigidly attached to one of each of the four upper legs. Each lower leg of the four lower legs is slidably engaged within the eyelet orifice of one of each of the four flanges. Each grommet of the four grommets has a lock hole, in which each grommet is pivotally attached to one of each of the four upper legs, wherein the lock hole of each grommet is slidably engaged with one of each of the four lower legs. The kit includes the unassembled constituents of the device. The method includes the steps of adjoining, abutting, affixing, conjoining, connecting, joining, linking, obtaining, opening, positioning, and sitting.

In view of the foregoing disadvantages inherent in the known type chair devices now present in the prior art, the present invention provides an improved adjustable chair device, which will be described subsequently in great detail, is to provide a new and improved adjustable chair device which is not anticipated, rendered obvious, suggested, or even implied by the prior art, either alone or in any combination thereof.

To attain this, the present invention essentially comprises a seat; a back; four upper legs; two armrests; four flanges; four lower legs; and four grommets. The back is pivotally attached to the seat. The four upper legs are pivotally attached to the seat. The each armrest of the two armrests is pivotally attached to two of the four upper legs and pivotally attached to the back. Each flange of the four flanges has an eyelet orifice, wherein each flange is rigidly attached to one of each of the four upper legs. Each lower leg of the four lower legs is slidably engaged within the eyelet orifice of one of each of the four flanges. Each grommet of the four grommets has a lock hole, in which each grommet is pivotally attached to one of each of the four upper legs, wherein the lock hole of each grommet is slidably engaged with one of each of the four lower legs.

There has thus been outlined, rather broadly, the more important features of the invention in order that the detailed description thereof that follows may be better understood, and in order that the present contribution of the art may be better appreciated.

The invention may also include a set of caps. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable chair device that has all the advantages of the prior art adjustable chair device and none of the disadvantages.

It is another object of the present invention to provide a new and improved adjustable chair device that may be easily and efficiently manufactured and marketed.

An even further object of the present invention is to provide a new and improved adjustable chair device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new adjustable chair device that provides in the apparatuses and methods of the prior art some of the advantages thererof, while simultaneously overcoming some of the disadvantages normally associated therewith.

Even still another object of the present invention is to provide an adjustable chair device having the interconnected elements of seat; a back; four upper legs; two armrests; four flanges; four lower legs; and four grommets. This combination of elements makes it possible to provide a reclining means for sitting on an uneven surface.

Still another object of the present invention is to provide a kit comprising the unassembled components of the device.

Lastly, it is an object of the present invention to provide a new and improved method of using comprising the steps of adjoining, abutting, affixing, conjoining, connecting, joining, linking, obtaining, opening, positioning, and sitting.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
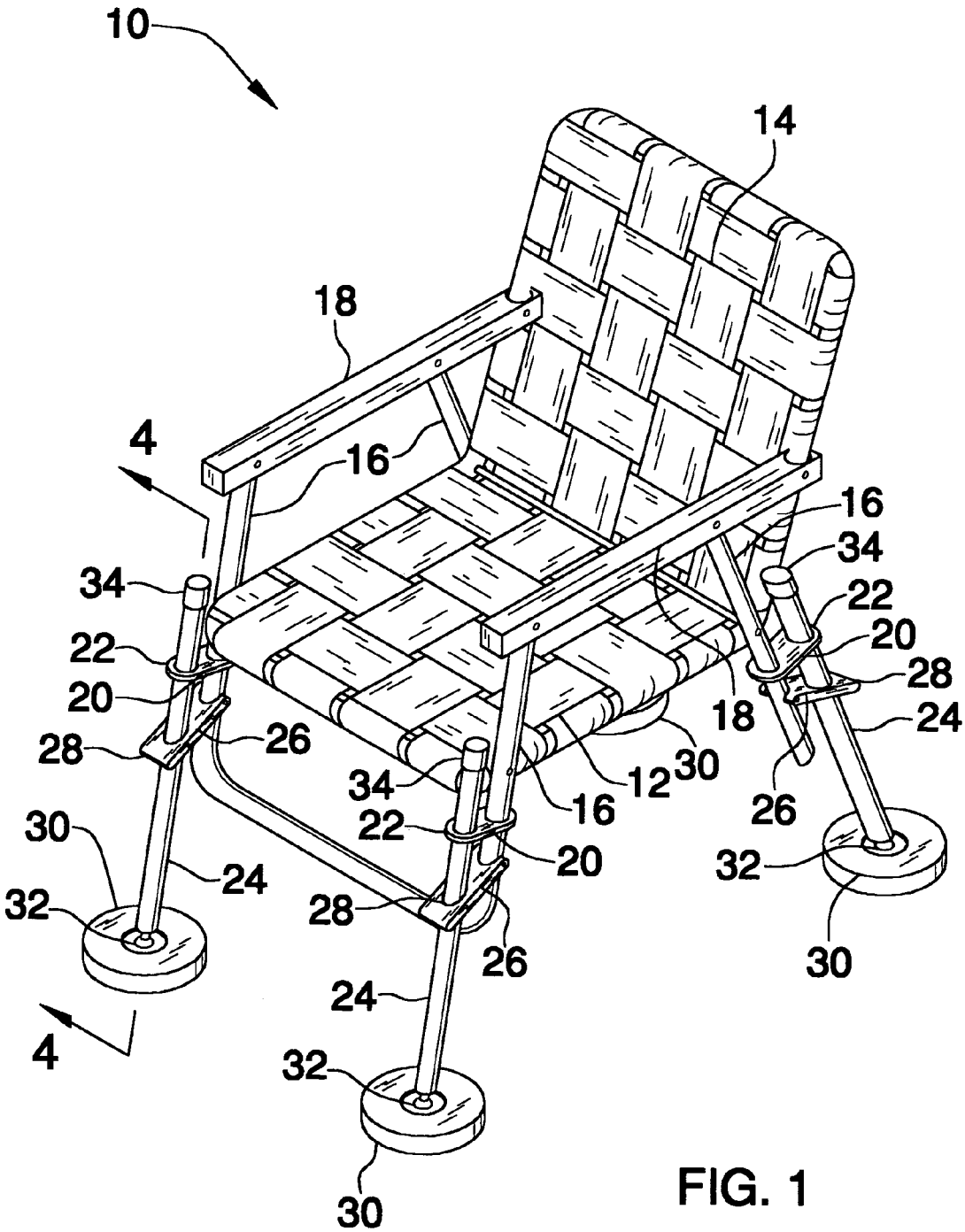
FIG. 1 is a perspective view of an preferred embodiment of the adjustable chair device constructed in accordance with the principles of the present invention.

Referring now to the drawings, and in particular FIGS. 1 to 4 thereof, one preferred embodiment of the present invention is shown and generally designated by the reference numeral 10. One preferred embodiment of a chair device 10 for use on an uneven surface 36 comprises a seat 12; a back14; four upper legs 16; two armrests 18; four flanges 20; four lower legs 24; and four grommets 26. The back14 is pivotally attached to the seat 12. The four upper legs 16 are pivotally attached to the seat 12. The each armrest 18 of the two armrests 18 is pivotally attached to two of the four upper legs 16 and pivotally attached to the back14. Each flange 20 of the four flanges 20 has an eyelet orifice 22, wherein each flange 20 is rigidly attached to one of each of the four upper legs 16. Each lower leg 24 of the four lower legs 24 is slidably engaged within the eyelet orifice 22 of one of each of the four flanges 20. Each grommet 26 of the four grommets 26 has a lock hole 28, in which each grommet 26 is pivotally attached to one of each of the four upper legs 16, wherein the lock hole 28 of each grommet 26 is slidably engaged with one of each of the four lower legs 24.

An optional set of four footers 30 may be added to the device 10 in which the optional each footer 30 of the four footers 30 is attached to one of each of the four lower legs 24.

An optional set of four swivel ball joints 32 and four footers 30 may be added to the device 10 in which each swivel ball joint 32 is attached to one of each of the four lower legs 24; and each footer 30 is pivotally attached to one of each of the swivel ball joints 32.

An optional cap 34 may be added to the device 10 in which the optional cap 34 is attached to one of each of the four lower legs 24.

The four upper legs 16 may be made of any commercially available materials in which one preferred configuration is that each upper leg 16 of the four upper legs 16 is made of aluminum tubing.

The lower leg 24 may be made of any commercially available materials in which one preferred configuration is that each lower leg 24 of the four lower legs 24 is made of aluminum tubing.

The seat 12 may be made of any commercially available materials in which one preferred configuration is that the seat 12 is made of aluminum tubing with nylon webbing. Another preferred configuration is that the seat 12 is made of aluminum tubing with fabric.

The back 14 may be made of any commercially available materials in which one preferred configuration is that the back 14 is made of aluminum tubing with nylon webbing. Another preferred configuration is that the back 14 is made of aluminum tubing with fabric.

The armrests 18 may be made of any commercially available materials in which one preferred configuration is that the armrests 18 are made of aluminum.

The four flanges 20 may be made of any commercially available materials in which one preferred configuration is that each flange 20 of the four flanges 20 is made of aluminum.

The four grommets 26 may be made of any commercially available materials in which one preferred configuration is that each grommet 26 of the four grommets 26 is made of aluminum.

The four footers 30 may be made of any commercially available materials in which one preferred configuration is that each footer 30 of the four footers 30 is made of a plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The four caps 34 may be made of any commercially available materials in which one preferred configuration is that each cap 34 of the four caps 34 is made of a plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

One preferred embodiment of a kit for a chair device 10 for use on an uneven surface 36, the kit comprising: a seat 12; a back 14 pivotally attached to the seat 12; four upper legs 16 pivotally attached to the seat 12; two armrests 18, each armrest 18 is pivotally attached to two of the four upper legs 16 and pivotally attached to the back14; four flanges 20, each flange 20 having an eyelet orifice 22, wherein each flange 20 is rigidly attachable to one of each of the four upper legs 16; four lower legs 24, each lower leg 24 is slidably engagable within the eyelet orifice 22 of one of each of the four flanges 20; and four grommets 26, each grommet 26 having a lock hole 28, each grommet 26 is pivotally attachable to one of each of the four upper legs 16, wherein the lock hole 28 of each grommet 26 is slidably engaged with one of each of the four lower legs 24.

An optional set of four swivel ball joints 32 and a set of four footers 30 may be added to the kit in which each swivel ball joint 32 is attachable to one of each of the four lower legs 24 and each footer 30 is pivotally attachable to one of each of the swivel ball joints 32.

An optional set of four caps 34 may be added to the kit in which each cap 34 is attachable to one of each of the four lower legs 24.

A method of using a kit for assembling a chair device 10 for use on an uneven surface 36, the method comprising the steps of: adjoining, abutting, affixing, conjoining, connecting, joining, linking, obtaining, opening, positioning, and sitting. The obtaining step comprises obtaining the kit comprising: a seat 12; a back14 pivotally attached to the seat 12; four upper legs 16 pivotally attached to the seat 12; two armrests 18, each armrest 18 is pivotally attached to two of the four upper legs 16 and pivotally attached to the back14; four flanges 20, each flange 20 having an eyelet orifice 22, wherein each flange 20 is rigidly attachable to one of each of the four upper legs 16; four lower legs 24, each lower leg 24 is slidably engagable within the eyelet orifice 22 of one of each of the four flanges 20; four grommets 26, each grommet 26 having a lock hole 28, each grommet 26 is pivotally attachable to one of each of the four upper legs 16, wherein the lock hole 28 of each grommet 26 is slidably engaged with one of each of the four lower legs 24; four swivel ball joints 32, each swivel ball joint 32 is attachable to one of each of the four lower legs 24; four footers 30, each footer 30 is pivotally attachable to one of each of the swivel ball joints 32; and four caps 34, each cap 34 is attachable to one of each of the four lower legs 24. The adjoining step comprises adjoining rigidly together each flange 20 of the four flanges 20 to one of each of the four upper legs 16. The affixing step comprises affixing slidably together each lower leg 24 within the eyelet orifice 22 of one of each of the four flanges 20. The conjoining step comprises conjoining together each grommet 26 of the four grommets 26 to one of each of the four upper legs 16. The linking step comprises linking slidably together each grommet 26 of the four grommets 26 with one of each of the four lower legs 24. The joining step comprises joining together each swivel ball joint 32 of the four swivel ball joints 32 to one of each of the four lower legs 24. The connecting step comprises connecting pivotally together each footer 30 of the four footers 30 to one of each of the swivel ball joints 32. The abutting step comprises abutting slidably together each cap 34 of the four caps 34 to one of each of the four lower legs 24, wherein the steps of adjoining, affixing, conjoining, linking, joining, connecting and abutting constitute assembling the kit into the device 10. The opening step comprises opening up the device 10. The positioning step comprises positioning the opened device 10 onto the uneven surface 36. The sitting step comprises sitting on the positioned device 10.

Referring now to FIG. 1 which depicts a perspective view of an preferred embodiment of the adjustable chair device 10 showing a seat 12; a back14; four upper legs 16; two armrests 18; four flanges 20; four lower legs 24; and four grommets 26. The back14 is pivotally attached to the seat 12. The four upper legs 16 are pivotally attached to the seat 12. The each armrest 18 of the two armrests 18 is pivotally attached to two of the four upper legs 16 and pivotally attached to the back14. Each flange 20 of the four flanges 20 has an eyelet orifice 22, wherein each flange 20 is rigidly attached to one of each of the four upper legs 16. Each lower leg 24 of the four lower legs 24 is slidably engaged within the eyelet orifice 22 of one of each of the four flanges 20. Each grommet 26 of the four grommets 26 has a lock hole 28, in which each grommet 26 is pivotally attached to one of each of the four upper legs 16, wherein the lock hole 28 of each grommet 26 is slidably engaged with one of each of the four lower legs 24. Also shown is the optional set of four swivel ball joints 32 and set of footers 30 in which each swivel ball joint 32 is attached to one of each of the four lower legs 24; and each footer 30 is pivotally attached to one of each of the swivel ball joints 32. In addition the optional set of caps 34 is shown in which each cap of the set of cap 34 is attached to one of each of the four lower legs 24.

Figure 2:
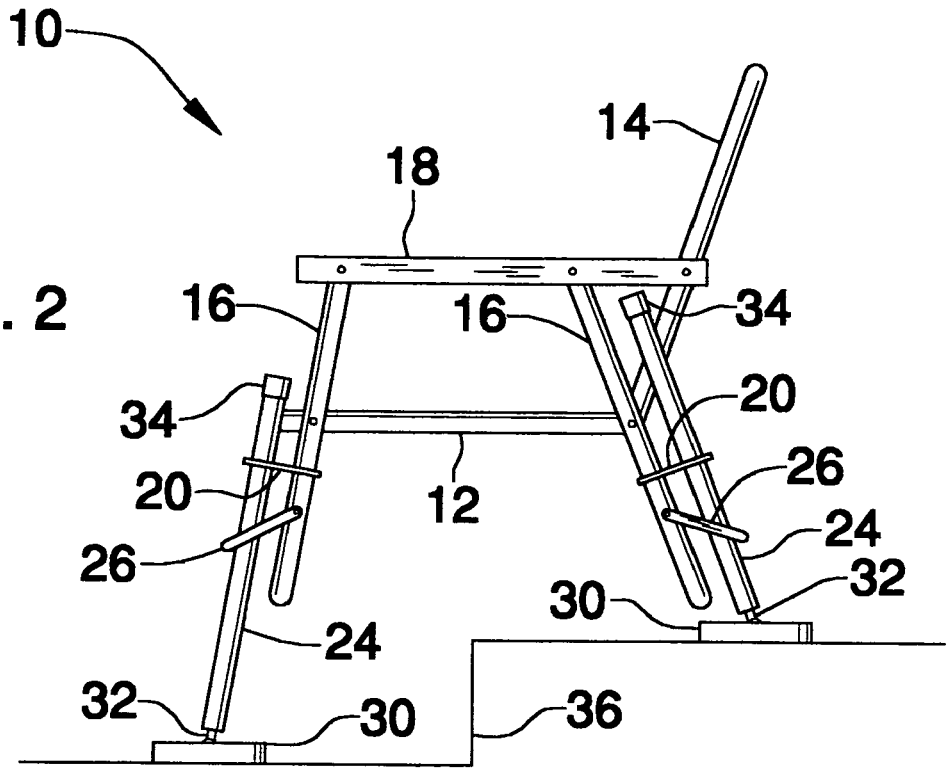
FIG. 2 is a side view of a preferred embodiment of the adjustable chair device of the present invention.

Referring now to FIG. 2 which depicts a side view of a preferred embodiment of the adjustable chair device 10 showing the device 10 positioned on a uneven surface 36 of a descending stair case.

Figure 3:
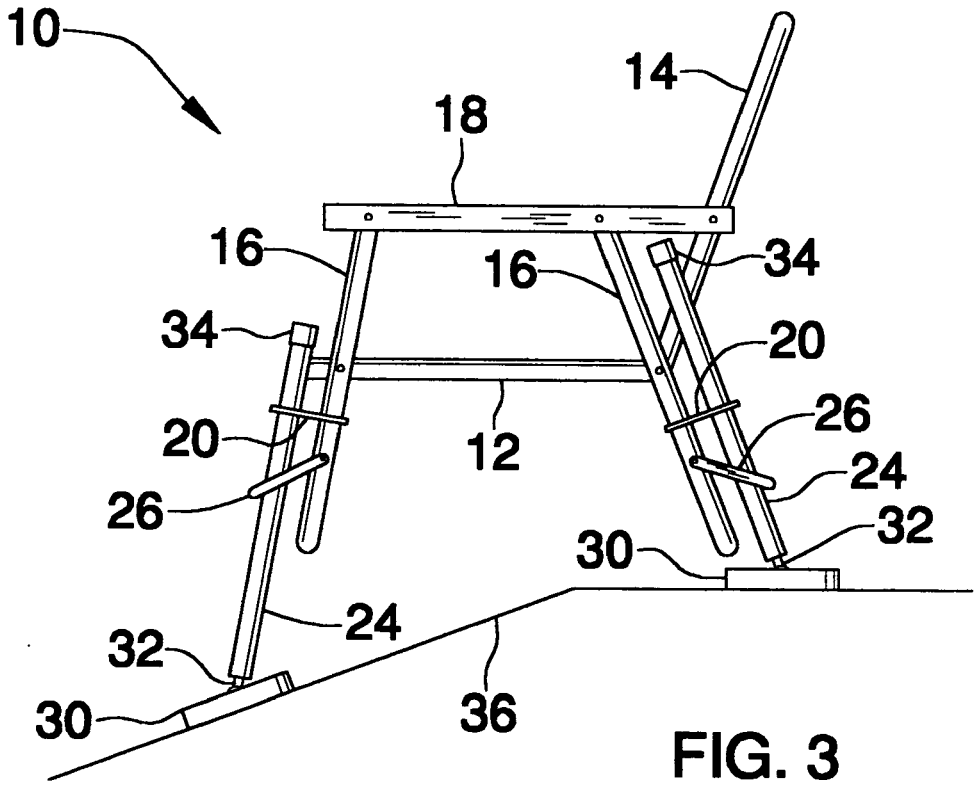
FIG. 3 is a side view of a preferred embodiment of the adjustable chair device of the present invention.

Referring now to FIG. 3 which depicts a side view of a preferred embodiment of the adjustable chair device showing which depicts a side view of a preferred embodiment of the adjustable chair device 10 showing the device 10 positioned on a uneven surface 36 of a descending slope.

Figure 4:
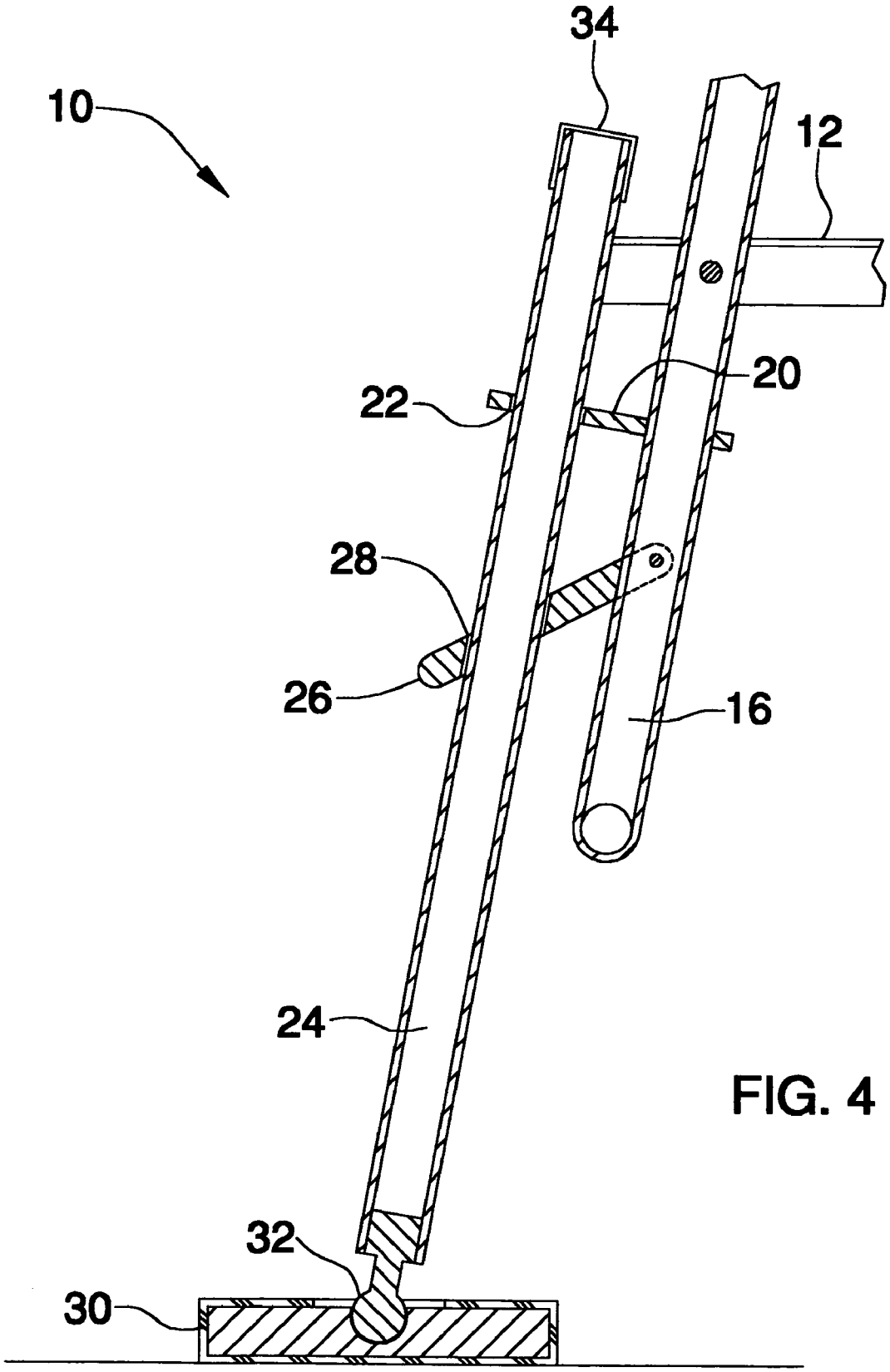
FIG. 4 is a partial cross sectional side view of a preferred embodiment of the adjustable chair device of the present invention.

Referring now to FIG. 4 which depicts a partial cross sectional side view of a preferred embodiment of the adjustable chair device showing a seat 12; an upper leg 16; an armrest18; a flange 20 with an eyelet orifice 22; a lower leg 24; a grommet 26 with a lock hole 28, a swivel ball joint 32, a footer 30 and a cap 34.

As to the manner of usage and operation of the present invention, the same should be apparent from the above description. Accordingly, no further discussion relating to the manner of usage and operation will be provided.

While a preferred embodiment of the adjustable chair device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable chair device for use on uneven surfaces comprising:

a seat;

a back pivotally attached to said seat;

four upper legs pivotally attached to said seat;

two armrests, each armrest is pivotally attached to two of said four upper legs and pivotally attached to said back;

four flanges, each flange having an eyelet orifice, wherein each flange is rigidly attached to one of each of said four upper legs;

four lower legs, each lower leg is slidably engaged within said eyelet orifice of one of each of said four flanges;

four grommets, each grommet having a lock hole, each grommet is pivotally attached to one of each of said four upper legs, wherein said lock hole of each grommet is slidably engaged with one of each of said four lower legs;

four swivel ball joints, each swivel ball joint is attached to one of each of said four lower legs;

four footers, each footer is pivotally attached to one of each of said swivel ball joints wherein each footer of said four footers is made of a plastic selected from the group consisting of neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymer, vinyl acetate polymers, and mixtures thereof; and four caps, each cap is attached to one of each of said four lower legs, wherein each cap of said four caps is made of a plastic selected from the group consisting of neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

2. A kit for an adjustable chair device for use on an uneven surface, said kit comprising:

a seat;

a back pivotally attached to said seat;

four upper legs pivotally attached to said seat;

two armrests, each armrest is pivotally attached to two of said four upper legs and pivotally attached to said back;

four flanges, each flange having an eyelet orifice, wherein each flange is rigidly attachable to one of each of said four upper legs;

four lower legs, each lower leg is slidably engagable within said eyelet orifice of one of each of said four flanges; and four grommets, each grommet having a lock hole, each grommet is pivotally attachable to one of each of said four upper legs, wherein said lock hole of each grommet is slidably engaged with one of each of said four lower legs;

four swivel ball joints, each swivel ball joint is attachable to one of each of said four lower legs;

four footers, each footer is pivotally attachable to one of each of said swivel ball joints;

wherein each footer of said four footers is made of a plastic selected from the group consisting of neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof; and four caps, each cap is attachable to one of each of said four lower legs, wherein each cap of said four caps is made of a plastic selected from the group consisting of neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

* * * * *